United States Patent [19]

Avritt et al.

[11] Patent Number: 4,843,429

[45] Date of Patent: Jun. 27, 1989

[54] METHOD AND APPARATUS FOR PRINTING NEAR PAGE BOUNDARIES

[75] Inventors: Michael D. Avritt, Boulder; Brent K. Hegerhorst, Berthoud, both of Colo.; Peter K. Peterson, Issaquah, Wash.

[73] Assignee: International Business Machines Corporation, Armonk, N.Y.

[21] Appl. No.: 188,241

[22] Filed: Apr. 29, 1988

[51] Int. Cl.[4] ..... G03G 15/00

[52] U.S. Cl. ..... 355/274; 355/317

[58] Field of Search ..... 355/3 TR, 14 TR, 3 SH, 355/14 SH, 3 CH

[56] References Cited

U.S. PATENT DOCUMENTS

| | | | |
|---|---|---|---|
| 3,914,047 | 10/1975 | Hunt, Jr. et al. | 355/16 |
| 4,110,027 | 8/1978 | Sato et al. | 355/3 TR |
| 4,169,673 | 10/1979 | Sato et al. | 355/3 TR |
| 4,299,477 | 11/1981 | Ward et al. | 355/14 R |
| 4,306,800 | 12/1981 | Kopp | 355/3 TR |
| 4,423,951 | 1/1984 | Rightmyre et al. | 355/3 TR |
| 4,541,710 | 9/1985 | McLeish | 355/13 |

FOREIGN PATENT DOCUMENTS

| | | | |
|---|---|---|---|
| 54-1036 | 1/1979 | Japan | 355/3 TR |
| 61-243464 | 10/1986 | Japan | 355/14 SH |

*Primary Examiner*—R. L. Moses
*Assistant Examiner*—J. Pendegrass
*Attorney, Agent, or Firm*—Charles E. Rohrer; Earl C. Hancock

[57] ABSTRACT

A machine uses electrophotography to produce panels of images for transfer to a continuous web of image receiving media. The images are transferred to the media under control of signals synchronized with media movement under a transfer structure which has a width sufficient to accommodate image transfer immediately prior to stopping of the media as well as immediately after restart of the media movement. The media is stopped with boundaries between sheets within the transfer zone.

8 Claims, 2 Drawing Sheets

METHOD AND APPARATUS FOR PRINTING NEAR PAGE BOUNDARIES

FIELD OF THE INVENTION

This invention relates to apparatus and method for transferring images from a continuously moving member to a web type media wherein the media web is periodically stopped and started or at least slowed and accelerated. This invention particularly relates to methods and means for reducing the unprinted zone necessary for accommodating stop and start operations associated with laser printers, which are fed with fanfold or continuous form copy sheets, separated by perforations at their boundaries.

BACKGROUND OF THE INVENTION

High speed electrophotographic printers such as the IBM 3800 Printer, employ a large photoconductive surfaced drum or belt to sequentially deliver image panels to a transfer station. The images frequently are electronically generated with a laser, LED array or the like selectively discharging the previously charged photoconductor. Where continuous form or fanfold paper with perforations defining the boundaries between sheets are employed, the movement of the images on the drum and paper requires coordination and synchronization since the image panels are not normally placed on the photoconductor with abutting boundaries.

Thus, it is necessary to periodically stop the image receiving media and separate it from the photoconductor until the next image approaches. The media is then again accelerated and brought into contact with the photoconductor. In the past, this has meant that a substantial guard band of no printing is required on either side of the perforation, or else some means of backing the paper up and resynchronizing its position with the photoconductor is needed.

Printers like the IBM 3800 printer typically skip about one inch of paper during a paperline stop-start. Disclosed is a method for reducing the unprinted zone necessary for a stop start function of the large printer paperline. This method uses a wide transfer zone to give a greater distance for stopping and starting the paperline.

Leaving minimal unprinted area above and below a forms perforation ("print to perf") is a requirement for many high speed printer users, particularly in Europe. Machines like the IBM 3800 printer typically leave about one half inch above and below each perforation during a normal stop/start operation at the paperline. It is particularly advantageous if it is possible to reduce this distance to one sixth inch above and below the perforation boundary between sheets. The prior art approach to solving this problem is by using a backhitch sequence at the transfer station.

Consider the contemporary machine which accommodates paperlines by requiring one half inch for paperline stop and one half inch for paperline start. Several things happen during a paperline stop. First the corona is turned off and the paper is pulled from the drum after which it is decelerated and stopped. Three tenths of an inch is required to let all print leave the transfer zone before the paper is pulled from the drum. Another two tenths inch is required for deceleration. Acceleration of the paperline takes three tenths of an inch. Another two tenths inch are allowed for settling of transients and lowering the paper onto the drum. Thus the half inch guard band on either side of the perforation boundary.

One method of printing to the perf, using the above described start stop profiles, is backing the paper up after deceleration and stop. Backing the paper up is called "backhitching". In order to accomplish the one sixth inch print from the perforation, it is necessary to back the paper up seven tenths of an inch. This backing up must take place in less than 30 milliseconds and requires design of all other parts associated with the paperline accommodation to let the paper back up. This capability of backing up before restarting also requires a more complicated servo system along with specially designed elements and, at best, is not a cheap alternative.

U.S. Pat. No. 3,914,047 by Hunt et al describes a technique for determining the location of the perforation in a media and timing control over machine stations in accordance with the location of the paper perforations. This patent relates to an electrophotographic copier wherein fanfold paper is sent through the transfer station. It does not suggest any method or means of printing close to the perforation (or copying close to the perforation), nor is there any discussion of restarting the paper line after a jam. Hunt et al maintain interframe spacing to eliminate image overlap and provide a space for a splice in the media web member.

U.S. Pat. No. 4,110,027 to Sato et al in FIG. 3 shows feeding of fanfold paper through a transfer zone between two rollers, which press the fanfold paper against the photoconductor before and after the transfer corona. The two rollers are movable from the position in contact with the photoconductive drum to a position separated from the drum, and in that manner, a fanfold paper is separated from the drum. That is, a mechanism separates the transfer paper from the drum at the transfer station and then restores the transfer paper into contact with the drum. The patent contains no teachings relative to printing close to the perforations in the fanfold paper.

U.S. Pat. No. 4,423,951 to Rightmyre relates to a copy machine for copying information onto fanfold paper and, in particular, relates to a roller transfer corona which physically holds the fanfold paper against the photoconductor drum, purporting to thereby overcome the problem of image voids that exist when using conventional xerographic copying systems with folded copy paper. There is no mention of a method of starting and stopping the paper within the machine, and maintaining transfer close to the perforated edge.

U.S. Pat. No. 4,541,710 by McLeish shows another fanfold copier in which the system includes a break associated with the supply of the fanfold material in order to keep a constant tension on the fanfold paper as it moves through the machine. There is no mention of a method of starting and stopping the machine, and printing close to the perforation.

DISCLOSURE OF THE INVENTION

The present invention is especially useful for xerographic or electrophotographic machines which have a member, usually in the form of a photoconductor surfaced drum or a belt, for transporting one or more transferable images. Where the machine uses a media of a continuous stream of panels separated at a boundary as by a perforation. The panels are intended to receive images from the transporting member at an image transferring station. Since the images are sequential but spaced on the transport member, the machine includes a device for moving the media in the form of machine controls which periodically stop and restart the media so that an inter-panel boundary is at least briefly positioned at a stop position in proximity to the transfer station.

The present invention includes a method and means for permitting image transfer to the media with minimal separation relative to the panel boundaries. It includes image transferring at the transferring station by use of an image transfer effecting area facing the media surface. This image transferring area extends a predetermined distance from both the upstream and downstream sides of the panel boundary stop position in the direction of the media movement. Image information is transferred to a first media panel in proximity to the trailing boundary of that panel as this trailing boundary initially encounters the upstream image transferring area. Immediately thereafter, the media panel is stopped with the boundary at the aforementioned stopping position.

Movement of the media is reinitiated as the next image panel on the transferable image transporting member approaches the transfer station so that the transporting member and the media reach a common velocity. This makes it possible to transfer the next panel image to the media in the downstream portion of the image transfer area as the leading boundary of the next media panel is in proximity to the downstream edge of the image transfer area.

Preferably, the image transferring is caused by a corona which has a wide mouth that defines a charge producing face for the image transfer effecting area. This cooperates with the media shifting structure or process that is responsive to controls for moving the media away from the transferable image transporting member immediately after the last image transfer to the panel and for moving the media into engagement with the image transporting member when the member and the media have attained a common velocity.

Generally, the image receiving media is a continuous web which is divided into sheets by severable perforations with both the media and the moving member passing through a transfer station in a common general upstream to downstream direction. Image transfer is through an elongated image transfer area, which faces the transfer station with the length of the transfer area in the upstream to downstream direction divided into four zones that are consecutively encountered by the media as it moves through the transfer station. Image information is transferred to the portion of the media facing the first zone as the trailing perforation of the sheet enters that first zone.

Next the web media is separated from the image transporting member and stopped so that the sheet perforation is in proximity with the end of the second zone. As the next image on the transporting member approaches the transfer station, the media is accelerated to the same velocity as the member as the inter-sheet perforation passes through the third zone. The next image is transferred to the next media sheet in at least one of the four zones as the leading edge of the perforation passes through the fourth zone. Thus, the ion charge transferring area can reside in all of the zones or only in those zones in which image transfer will occur..

Accordingly, this invention involves establishing at the transfer station an image transferring area extending predetermined distances from the upstream and downstream sides of the panel boundary stop position in the direction of the media movement. Image information is transferred to a media panel in proximity to the trailing boundary of that panel as the trailing boundary initially encounters the upstream image transferring means area. The media panel is stopped with the boundary at the stopping position. After detecting that the next transferable image on the transporting member is approaching the transfer station, movement of the media is initiated so that the transporting member and the media reach a common velocity. Then transfer of the next panel image to the media is enabled as the leading boundary of the next media panel is in proximity to the downstream edge of the image transfer area in the downstream portion of the image transfer area.

Thus, this invention involves the provision of a wide transfer zone through provision of a wide transfer corona, or more than one transfer corona. The method and apparatus described herein when applied to a machine such as an IBM 3800 printer, can reduce the one inch guard band distance around the perforations to one third inch. Using a wide transfer zone in conjunction with image transfer controls makes it possible to avoid backhitching and allows a simpler servo system and paperline control than was possible with the prior art systems.

Those having normal skill in the art will recognize the foregoing and other objects, features, advantages and applications of the present invention from the following more detailed description of the preferred embodiments as illustrated in the accompanying drawings.

DETAILED DESCRIPTION OF THE PREFERRED EMBODIMENTS

Figure 1:
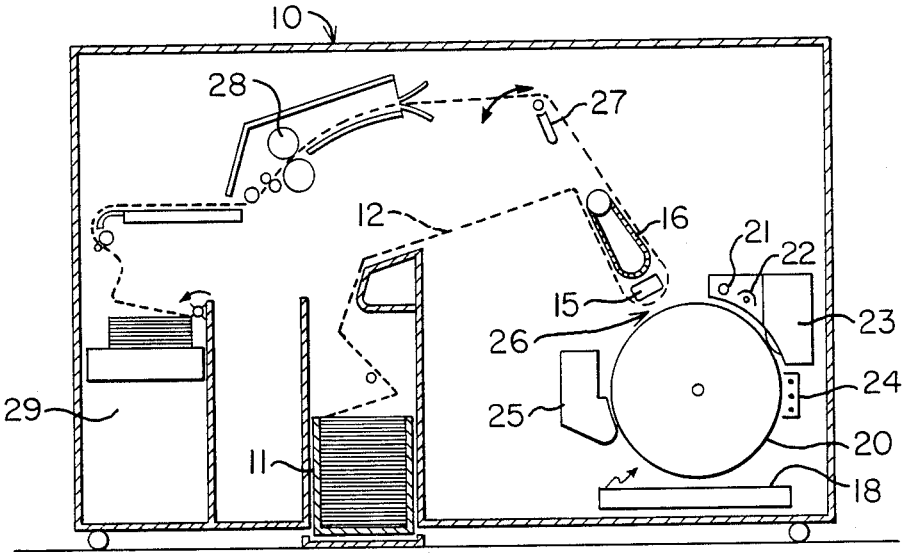
FIG. 1 is a printer using continuous form media and incorporating the present invention.

A high speed printer 10 using an electrophotographic process is shown in FIG. 1. A supply bin 11 holds a stack of fanfold media 12 intended to receive the images developed by printer 10. Preferably media 12 is a stream of paper formed as a series of sheets having inter-sheet boundaries formed by perforations. It is guided along a path including the transfer station around image transfer assembly 15 where it is motivated by a tractor drive 16.

The image originates at an electronic module 18 such as by a laser and rotating mirror device. Module 18 might also include an arrangement for concurrently applying whole image panels to the photoconductor ("PC") on the peripheral surface of drum 20. Essentially the PC acts as an image transporting member for delivering the image to the transfer station 26. A series of conventional elements are arrayed around the periphery of drum 20 including an erase lamp 21, preclean corona 22, cleaner brush 23, a charge corona 24 and a developer 25. As is well known, these elements cooperate to charge the PC, selective discharge it to form the image, and apply toner to the image to render it visible.

The image defining toner is transferred to media 12 in the transfer station 26.

Web 12 is maintained in tension by pivotable arm 27 and passes through fuser 28 where the toner is melted onto the paper. The web is ten delivered to an output module such as bin 29. Bin 29 can include a burster/-trimmer/stacker or such a unit can form an alternate output receptacle.

The images applied to the PC of drum 20 are not in an abutting relationship. That is, there is a variable space between image panels. However, the web 12 is formed of abutting sheets. Therefore it is necessary to periodically stop and restart the movement of web 12 through the transfer station. The machine controls of contemporary such printers accommodate this velocity profiling in a well known manner.

In accordance with the present invention, a relatively wide transfer zone is employed in conjunction with synchronized control of image transfer thereby making it possible to print closer to the sheet perforation boundaries than ever before. For simplicity, assume the transfer zone is one inch in width. Paperline stop occurs as follows.

Figure 2:
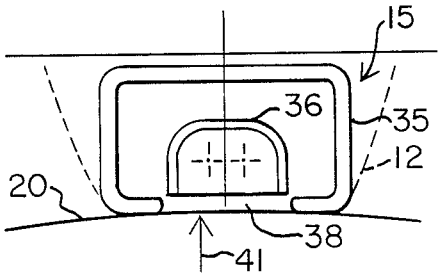
FIGS. 2 through 5 are illustrations of the sequence of coordinated media movement and image transfer operations in accordance with this invention for the FIG. 1 machine.
Figure 4:
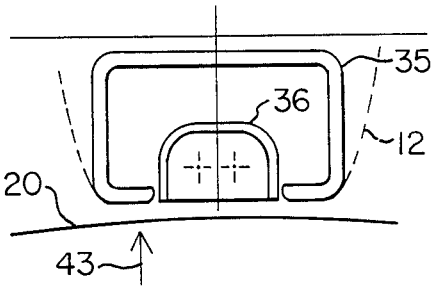
Figure 5:
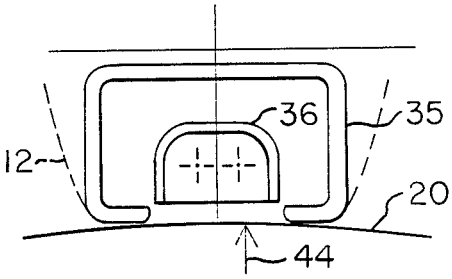

As indicated by arrow 41 in FIG. 2, the last line of print enters the transfer zone 26 just far enough to accomplish transfer, one quarter inch. After the last line has entered one quarter inch into the zone, the paper is pulled away from the drum and decelerated to a stop with the last line in the center of the transfer zone as shown by arrow 42 in FIG. 3. When the next image on the drum 20 is six tenths of an inch from the last line transferred as reflected by arrow 43 in FIG. 4, paper acceleration is started. The paper is accelerated such that it takes three tenths of an inch to reach drum speed. The drum will have traveled twice as far as the paper leaving one third inch between the print which was transferred to the paper and the print which is yet to be transferred. The paper is now brought down onto the drum with the first line of untransferred print in the last one quarter inch of the transfer zone as indicated by arrow 44 in FIG. 5.

Image transfer now takes place and printing continues until the next stop. With the one third inch distance between the print transferred before the stop and the print transferred after the stop, the one sixth inch print to perf is accomplished. This print to perf method requires no relative motion between the drum and paper as the paper is pulled away and lowered onto the drum. With the sequence described, adequate transfer takes place within the first and last quarter of the transfer zone.

Accordingly, the invention relates to a method of providing a short distance between the last line printed and the next line printed when a continuous form printer, such as the IBM 3800, is brought to a stop. The method enables a printer to print close to the perforation of fanfold paper on both the trailing and leading edges. Contemporary machines are not allowed to print to within ½-inch above and below each perforation which is an unacceptably large nonprint area for many applications. With the current invention, it is possible to print to within 1/6" of the perforation on both the trailing and leading edge side.

Figure 3:
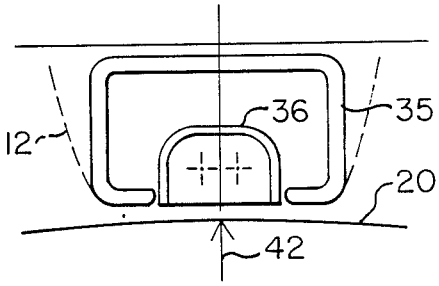

In a practical application of this invention, the width of the transfer zone at the face of fixed transfer corona 36 was 1 inch in width. When the last line of print enters the transfer zone by ¼-inch, transfer occurs. As seen in FIG. 3, the guide housing 35 surrounding fixed transfer corona 35 is pulled away from the drum thereby removing paper 12 from the drum surface. Web paper 12 is then decelerated to a stop with the last line then in the center of the transfer zone (FIG. 3).

Upon approach of the next information contained on image drum 20 to a point 6/10th of an inch from the last line on the transferred paper, acceleration of the paper is started. This acceleration takes 3/10th of an inch to reach drum speed and as a consequence, the last line is then 2/10ths of an inch from the end of the transfer zone. During that period of time, the drum will have traveled twice as far as the paper leaving ⅓-inch between the last line on the paper and the first line yet to be transferred. At this point, the first line is in the center of the transfer zone.

The paper is next brought down onto the drum such that the next image line will have practically a full ½ of the transfer zone in which transfer can occur. In this manner, only ⅓ exits between the last line on one sheet and the first line on the second sheet with the perforation between the two sheets 1/6th of an inch from each line.

The transfer corona 36 remains fixed relative to the machine frame as the paper web guide 35 is moved. Varying of the width of the opening of the grid is possible by using an apertured scorotron for corona 36. Effective transfer occurs soon after the character enters the transfer zone. However, transfer efficiency may improve with more time in the transfer zone.

During or prior to deceleration separation of paper 12 from drum 20 must occur without appreciable slippage to avoid character stretch. Additionally, acceleration and transient die out must have occurred before the paper contacts the photoconductive surface of drum 20 to avoid character stretch.

As another example of a procedure at transfer to stop and start paper without backhitch, assume transfer zone 26 is 20mm wide extending 10mm on either side of scorotron 36 center line, and there is an allowable nonprofit zone on either side of the perforations on continuous forms paper is 4mm. Assume further a photoconductor/paper speed between 810mm/sec and 32mm/sec and the drum 20 has a seal 1-inch wide (25.4mm) which, at closest, is 2.6mm from the perf.

On decelerate/stop, the perforation just enters transfer zone with the last character in the transfer zone for 4mm, 4.9m sec. Power is removed from corona 36 and housing 35 begins moving the paper guides away from the drum (2.08mm, 2.5 ms. Decelerate to bring the perforation to the center of the transfer zone involves 7.92mm photoconductor movement, 3.96mm of paper movement, and 9.7m sec.

If effective transfer occurs shortly after entry into the transfer zone, then it is possible to stop the paper and pull it away from the drum before the character passes outside the transfer zone.

Acceleration is begun and guides 35 are moved toward drum 20 with acceleration and transient alternation complete before paper contact with the drum PC. This takes 7mm. and 8.6m sec. Power is reapplied to corona (scorotron) 36 and the first character has 7mm, 8.6m sec. in the transfer zone to achieve effective transfer. Powering corona 36 just before contact may help tack paper 12 to drum 20 and reduce sensitivity to transients. During deceleration and acceleration, the paper moves 7.92 mm while the drum moves approximately 15.84 mm in 19.5m sec. The total gap with (7×) 11 in. sheets is 1.207in. =30.65mm.

Figure 6:
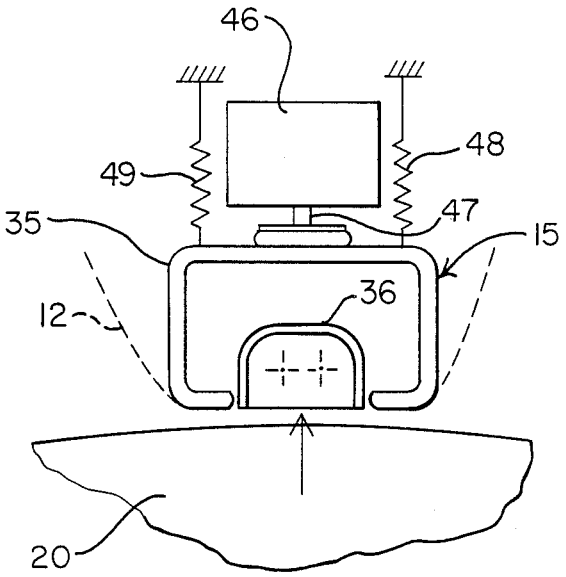
FIG. 6 is an exemplary mechanism for moving the transfer media relative to the drum.

FIG. 6 is a paper positioning mechanism using a solenoid 46 with its extendable shaft 47 attached to the paper guide housing 35 of assembly 15. Springs 48 and 49 urge housing 35 away from the PC surface of drum 20. Actuation of solenoid 46 forces paper 12 into engagement with the drum 20. Paper tension force is essentially supplied by means not shown such as a clutched roller, a vacuum column or other means.

Figure 7:
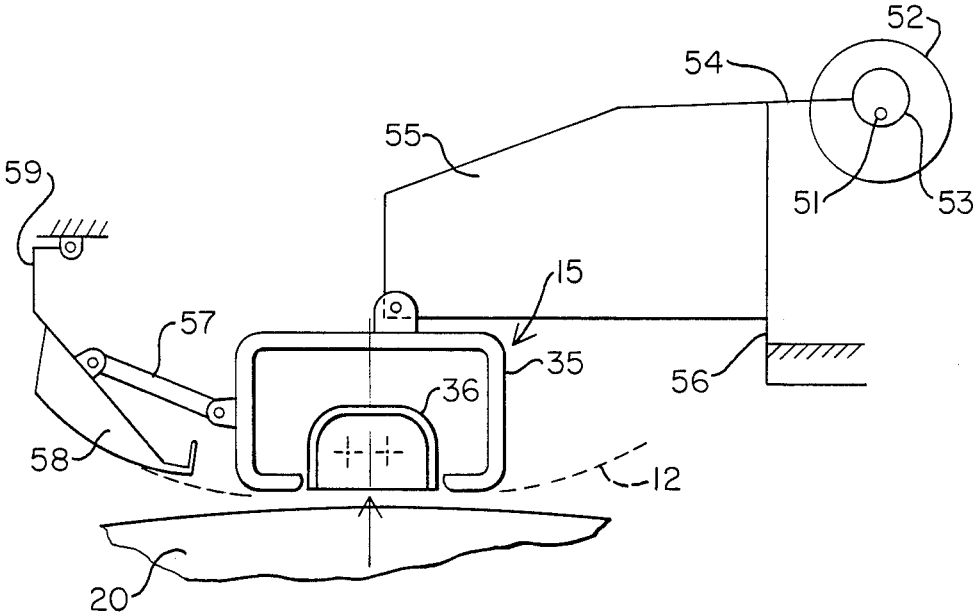
FIG. 7 is another mechanism for controlling transfer media positioning with the drum.

Positioning of housing 35 is likewise obtained by the FIG. 7 mechanism. A stepper motor 52 drives its shaft 51 which in turn drives an eccentric 53. Stepper motor 52 can respond to a predetermined motion profile. Leaf spring 54 follows eccentric 53 and is attached to linkage 55 as is leaf spring 56. Linkage 55 rotates about the mid-point of spring 56 to push the movable guide 35 toward drum 20. Linkage 57 is pulled which causes the paper tension spring carrier 59 to pivot towards the guide housing 35 thus compensating for the change in paper length due to the guides 35 movement. Curved shield 58 applies tension to paper 12. Springs 54 and 56 produce the return force to move the guides 35 away from drum 20 and cause the paper tension spring carrier 59 to pivot away from guides 35.

While the exemplary preferred embodiments of the present invention are described herein with particularity, those having normal skill in the art will recognize various changes, modifications, additions and applications other than those specifically mentioned herein without departing from the spirit of this invention.

What is claimed is:

1. In a machine having a member transporting a transferable image and a device for moving a media in the form of a continuous stream of panels intended to receive images from the transporting member at an image transferring station wherein the media panels are separated at a boundary with the machine controls periodically stopping and restarting the media so that an inter-panel boundary is at least briefly positioned at a stop position in proximity to the transfer station, apparatus for permitting image transfer to the media with minimal separation relative to the panel boundaries comprising:

image transferring means at the transferring station, said image transferring means having an image transfer effecting area facing the media surface and extending predetermined distances from the upstream and downstream sides of the panel boundary stop position in the direction of the media movement, and control means for transferring image information to a media panel in proximity to the trailing boundary of said panel as said trailing boundary initially encounters said upstream image transferring means area and immediately thereafter stopping said media panel with the boundary at the stopping position, said control means further initiating movement of the media as the next image panel on the transferable image transporting member approaches the transfer station for causing the transporting member and the media to reach a common velocity for enabling transfer of the next panel image to the media in said downstream portion of the image transfer area as the leading boundary of said next media panel is in proximity to the downstream edge of said image transfer area.

2. Apparatus in accordance with claim 1 wherein said image transferring means is a corona with a charge producing face defining said image transfer effecting area.

3. Apparatus in accordance with claim 2 which includes media shifting means responsive to said control means for moving the media away from the transferable image transporting member immediately after the last image transfer to said panel and for moving the media into engagement with the image transporting member when the member and said media have attained said common velocity.

4. In a device having a continuously moving member with transferable image information contained in sequential panels on its surface and a continuous web of image receiving media which is divided into sheets by severable perforations with both the media and the moving member passing through a transfer station in a common general upstream to downstream direction, apparatus for image transfer control comprising:

image transfer means having an elongated image transfer area facing the transfer station with the length of said area in the upstream to downstream direction divided into four zones consecutively encountered by the media as it moves thru the transfer station, means for transferring image information to the portion of the media facing the first said zone as the trailing perforation of the sheet enters said first zone, means for separating said media from the image transporting member and for stopping said web media so that said sheet perforation is in proximity with the end of the second said zone, means responsive to the approach of the next image on the transporting member to the transfer station for accelerating the media to the same velocity as the member as said perforation passes through the third said zone, and means for transferring the initial said next image to the next said sheet in at least one of said zones as the leading edge of the perforation passes through the fourth said zone.

5. Apparatus in accordance with claim 4 wherein said image transferring means includes a ion charge generating means with an open face defining said transfer area zones.

6. A process for image transfer to a moving media in the form of a continuous stream of panels intended to receive images from a transferable image transporting member at an image transferring station wherein the media panels are separated at a boundary with the media periodically stopping and restarting so that an inter-panel boundary is at least briefly stopped in proximity to the transfer station, comprising the steps of:

establishing at the transfer station an image transferring area extending predetermined distances from the upstream and downstream sides of the panel boundary stop position in the direction of the media movement, and transferring image information to a media panel in proximity to the trailing boundary of said panel as said trailing boundary initially encounters said upstream image transferring means area, stopping said media panel with the boundary at the stopping position, detecting that the next transferable image on the transporting member is approaching the transfer station, initiating movement of the media in response to said detecting step, causing the transporting member and the media to reach a common velocity, and enabling transfer of the next panel image to the media as the leading boundary of said next media panel is in proximity to the downstream edge of said image transfer area in the downstream portion of the image transfer area.

7. The process in accordance with claim 6 which includes the step of producing an image transferring charge at the transfer station in said transfer areas wherein image information is transferred thereby defining said image transfer effecting area.

8. The process in accordance with claim 7 which includes the steps of shifting the media away from the transferable image transporting member immediately after the last image transfer, and moving the media into engagement with the image transporting member when the member and said media have attained said common velocity.

* * * * *